US012600006B2

(12) United States Patent
Heo et al.

(10) Patent No.: US 12,600,006 B2
(45) Date of Patent: Apr. 14, 2026

(54) POLISHING PAD WITH WINDOW AND METHOD OF MANUFACTURING THE SAME

(71) Applicants: SK hynix Inc., Icheon-si (KR); SK enpulse Co., Ltd., Pyeongtaek-si (KR)

(72) Inventors: Yu Jin Heo, Icheon-si (KR); Hyun Goo Kang, Icheon-si (KR); Go Un Kim, Icheon-si (KR); Jang Won Seo, Pyeongtaek-si (KR); Sung Hoon Yun, Pyeongtaek-si (KR)

(73) Assignees: SK hynix Inc., Icheon-si (KR); ENPULSE CO., LTD., Cheonan-si (KR)

( * ) Notice: Subject to any disclaimer, the term of this patent is extended or adjusted under 35 U.S.C. 154(b) by 828 days.

(21) Appl. No.: 18/048,191

(22) Filed: Oct. 20, 2022

(65) Prior Publication Data

US 2023/0158633 A1 May 25, 2023

(30) Foreign Application Priority Data

Nov. 19, 2021 (KR) ..... 10-2021-0160738

(51) Int. Cl.
*B24B 37/20* (2012.01)
*B24B 37/22* (2012.01)
(Continued)

(52) U.S. Cl.
CPC ..... *B24B 37/205* (2013.01); *B24B 37/22* (2013.01); *B24B 37/24* (2013.01); *B24B 37/26* (2013.01)

(58) Field of Classification Search
CPC ..... B24B 37/205; B24B 37/013; B24B 49/12
See application file for complete search history.

(56) References Cited

U.S. PATENT DOCUMENTS 5,893,796 A * 4/1999 Birang ..... G01B 11/06 451/526
6,719,818 B1 * 4/2004 Birang ..... B24D 7/12 51/296
(Continued)

FOREIGN PATENT DOCUMENTS

CN 108701600 A 10/2018
CN 109202693 A 1/2019
(Continued)

*Primary Examiner* — Joel D Crandall

(57) ABSTRACT

This invention relates to a polishing pad and a method for manufacturing the same. The polishing pad may include a top pad layer and a window block. The top pad layer may include a groove pattern formed on an upper surface of the top pad layer. A first hole may be formed through the top pad layer. The window block may be inserted into the first hole. The top pad layer and the window block may have a structure coincided with following Formula 1.

$$1.1 \le \frac{\text{Gap} + Thk_{RTPC}}{Thk_{grv}} \le 3.0 \qquad \text{Formula 1}$$

In Formula 1, the gap may indicate a height difference between an upper surface of the top pad layer and an upper surface of the window block, the $\text{Thk}_{RTPC}$ may indicate a thickness of the window block, and the $\text{Thk}_{grv}$ may indicate a depth of the groove pattern.

19 Claims, 8 Drawing Sheets

(51) Int. Cl.
*B24B 37/24* (2012.01)
*B24B 37/26* (2012.01)

(56) References Cited

U.S. PATENT DOCUMENTS 6,855,034 B2 * 2/2005 Hasegawa ..... B24D 3/344 451/529
7,229,337 B2 * 6/2007 Lim ..... B24B 37/013 451/6
7,323,415 B2 * 1/2008 Shiho ..... B24B 37/205 438/692
7,621,798 B1 * 11/2009 Bennett ..... B24B 37/205 451/6
2002/0137431 A1 * 9/2002 Labunsky ..... B24B 49/12 451/526
2004/0082271 A1 * 4/2004 Wiswesser ..... B24B 37/205 451/6
2004/0224611 A1 * 11/2004 Aoi ..... B24B 37/205 451/6
2004/0253910 A1 * 12/2004 Lim ..... B24B 37/205 451/527
2005/0064802 A1 * 3/2005 Wiswesser ..... B24B 49/12 451/285
2005/0148183 A1 7/2005 Shiro et al.
2009/0305610 A1 * 12/2009 Yilmaz ..... B24B 37/013 451/6
2014/0256232 A1 9/2014 Repper et al.
2017/0120417 A1 5/2017 Lefevre et al.
2019/0232459 A1 8/2019 Gadinski et al.

FOREIGN PATENT DOCUMENTS

CN 110785259 A 2/2020
EP 2177312 A1 4/2010
JP 5503019 B2 5/2014
JP 5503039 B2 5/2014
KR 101890331 B1 8/2018
KR 1020190114264 A 10/2019
KR 101945869 B1 11/2019
KR 102257834 B1 5/2021

* cited by examiner

POLISHING PAD WITH WINDOW AND METHOD OF MANUFACTURING THE SAME

CROSS-REFERENCES TO RELATED APPLICATION

The present application claims priority under 35 U.S.C. § 119(a) to Korean application number 10-2021-0160738, filed on Nov. 19, 2021, in the Korean Intellectual Property Office, which is incorporated herein by reference in its entirety.

BACKGROUND

1. Technical Field

Various embodiments generally relate to a window insert type polishing pad, more particularly, to a polishing pad with a window insert having accurate sensing without a leakage of water to be readily used in a chemical mechanical polishing process, and a method of manufacturing the window insert-type polishing pad.

2. Related Art

A polishing pad may be an indispensable part in a chemical mechanical polishing (CMP) process, which is one of a plurality of semiconductor fabrication processes. The CMP process may include attaching a wafer to a head, contacting the wafer with a surface of the polishing pad on a platen, supplying slurry to a surface of the wafer and rotating the platen and the head to remove any unnecessary portion or debris on the wafer, thereby planarizing the surface of the wafer.

Recently, an end point detection apparatus including a real time pressure control (RTPC) sensor may measure a thickness of a layer to determine the flatness of the wafer and to detect an end point of the CMP process in an in-situ process. Endpoint detection methods are used to measure the endpoint of the etching process to prevent etching through the overlayers by stopping the etching process before the overlayers are etched through.

A window insert type polishing pad may be capable of detecting the end point of the CMP process that polishes the wafer by using a window installed at the polishing pad and the RTPC sensor installed at the window.

However, water leakage may be easily generated through a gap between a polished layer and a window block so that failure of the CMP process may easily occur and the metal layer of the wafer may not be accurately sensed. Further, the polishing pads may need to be frequently replaced before reaching the end of service due to the fear of such failures, which would lead to an increase in the consumption rate of the polishing pads.

SUMMARY

According to embodiments of the disclosure, there may be provided a window insert type polishing pad. The window insert type polishing pad may include a top pad layer and a window block. The top pad layer may include a groove pattern formed on an upper surface of the top pad layer. A first hole may be formed through the top pad layer. The window block may be inserted into the first hole. The top pad layer and the window block may have a structure satisfying Formula 1.

$$1.1 \leq \frac{\text{Gap} + Thk_{RTPC}}{Thk_{grv}} \leq 3.0 \qquad \text{Formula 1}$$

In Formula 1, the gap may indicate a height difference between an upper surface of the top pad layer and an upper surface of the window block, the $\text{Thk}_{RTPC}$ may indicate a thickness of the window block, and the $\text{Thk}_{grv}$ may indicate a depth of the groove pattern.

In example embodiments, the polishing pad may further include a sub-pad layer arranged under the top pad layer. The sub-pad layer may include a second hole formed through a portion of the sub-pad layer corresponding to a position of the first hole. The second hole may have an area smaller than an area of the first hole.

In example embodiments, the polishing pad may further include a third adhesive layer formed on a lower surface of the window block. The sub-pad layer may include a thermally fused portion formed at a portion of the sub-pad layer adjacent to the lower surface of the window block.

In example embodiments, the top pad layer and the window block may have a structure satisfying Formula 2.

$$1.1 \leq \frac{\text{Gap} + Thk_{RTPC}}{Thk_{grv}} \leq 1.9 \qquad \text{Formula 2}$$

According to example embodiments, there may be provided a method of manufacturing a window insert type polishing pad. In the method of manufacturing the window insert type polishing pad, a window block may be inserted into a first hole formed through a top pad layer. A gap-controlling film may be arranged on a surface of the window block. The upper surface of the gap-controlling film may then be pressed. A gap corresponding to a thickness of the gap-controlling film may be formed between an upper surface of the top pad layer and an upper surface of the window block.

According to example embodiments, there may be provided a method of manufacturing a window insert type polishing pad. In the method of manufacturing the window insert type polishing pad, a first hole may be formed through a top pad layer having a groove pattern. A window block may be installed at the first hole to form the polishing pad including the top pad layer and the window block. The top pad layer and the window block may be formed by following Formula 1.

$$1.1 \leq \frac{\text{Gap} + Thk_{RTPC}}{Thk_{grv}} \leq 3.0 \qquad \text{Formula 1}$$

In Formula 1, the gap may indicate a height difference between an upper surface of the top pad layer and an upper surface of the window block, the $\text{Thk}_{RTPC}$ may indicate a thickness of the window block, and the $\text{Thk}_{grv}$ may indicate a depth of the groove pattern.

In example embodiments, installing the window block may include installing the window block at the first hole, arranging a gap-controlling film on a surface of the window block, and pressing the gap-controlling film. A gap corresponding to a thickness of the gap-controlling film may be formed between an upper surface of the top pad layer and an upper surface of the window block.

In example embodiments, the top pad layer and the window block may be formed by following Formula 2.

$$1.1 \leq \frac{\text{Gap} + Thk_{RTPC}}{Thk_{grv}} \leq 1.9 \quad \text{Formula 2}$$

In example embodiments, the method may further include forming a first adhesive layer and a sub-pad layer on a lower surface of the top pad layer. The method may further include bonding a sheet for the sub-pad layer to a lower surface of a sheet for the top pad layer using adhesive to form a bond structure including the sub-pad layer, the first adhesive layer and the top pad layer sequentially stacked. The sheet for the sub-pad layer may have a second hole having a cross sectional area smaller than a cross sectional area of the first hole. A third hole may be formed through the first adhesive layer. The third hole may have an area substantially the same as the area of the second hole. A moisture-curable adhesive may be coated on an upper surface of the first adhesive layer around the third hole. A window block may be installed at the first hole of the bond structure.

BRIEF DESCRIPTION OF THE DRAWINGS

The above and another aspects, features and advantages of the subject matter of the present disclosure will be more clearly understood from the following detailed description taken in conjunction with the accompanying drawings, in which.

DETAILED DESCRIPTION

Figure 1A:
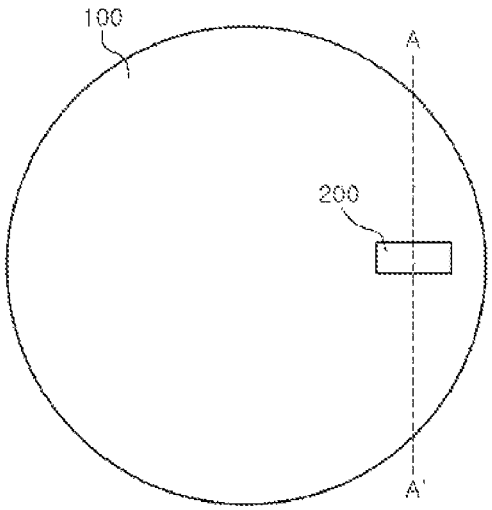
FIGS. 1A and 1B are a plan view illustrating a polishing pad in accordance with an embodiment of the disclosure.
Figure 1B:
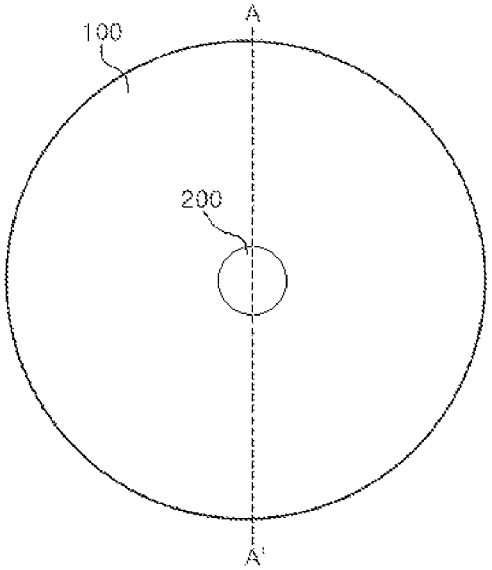
Figure 2:
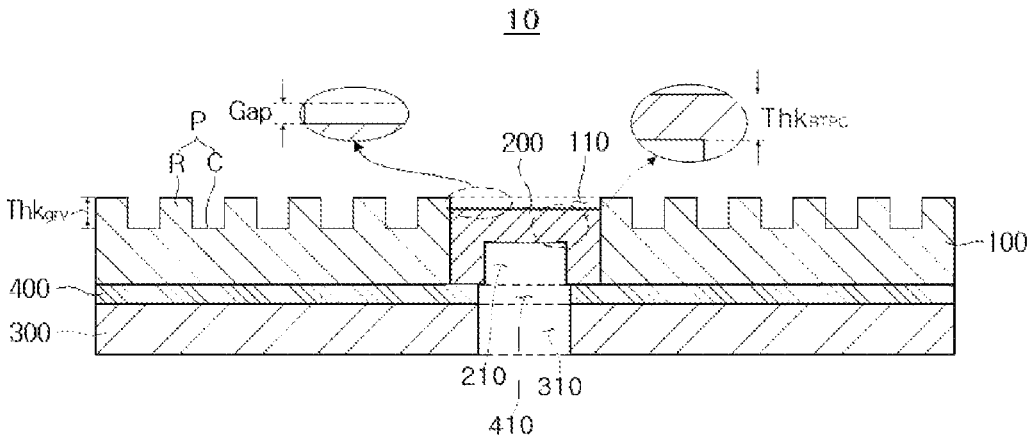
FIG. 2 is a cross-sectional view taken along a line A-A' in FIGS. 1A and 1B.

FIGS. 1A and 1B are a plan view illustrating a polishing pad in accordance with an embodiment of the disclosure and FIG. 2 is a cross-sectional view taken along a line A-A' in FIGS. 1A and 1B.

Referring to FIGS. 1A, 1B, and 2, a polishing pad 10 may include a top pad layer 100 and a window block 200. The top pad layer 100 and the window block 200 may have a structure defined by the following Formula 1.

$$1.1 \leq \frac{\text{Gap} + Thk_{RTPC}}{Thk_{grv}} \leq 3.0 \quad \text{Formula 1}$$

In Formula 1, the 'Gap' may indicate a height difference between an upper surface of the top pad layer 100 and an upper surface of the window block 200, the $Thk_{RTPC}$ may indicate a thickness of the window block 200, and the $Thk_{grv}$ may indicate a depth of a groove pattern formed at the upper surface of the top pad layer 100.

As shown in FIG. 1A, the window block 200 may be arranged at an edge portion of the top pad layer 100 between the center and an outside edge of the top pad layer 100. Alternatively, as shown in FIG. 1B, the window block 200 may be arranged at a central portion of the top pad layer 100.

The top pad layer 100 may closely contact a wafer to polish a surface of the wafer. As shown in FIG. 2, the window block 200 may be inserted into the top pad layer 100. A first hole 110 may be formed through the top pad layer 100. The first hole 110 may be used for measuring a reflectivity of the wafer to detect an end point. The first hole 110 may have various shapes. Particularly, the first hole 110 may have a circular shape having a diameter of about 10 mm to about 100 mm, or an elliptical shape. Alternatively, the first hole 110 may have a quadrangular shape having a lateral length of about 10 mm to about 100 mm and a longitudinal length of about 10 mm to about 100 mm. The polishing pad 10 may have a viewing angle for accurately measuring the reflectivity of the wafer. For example, the first hole 110 may have an area of about 1 $cm^2$ to about 70 $cm^2$, and preferably, about 6 $cm^2$ to about 15 $cm^2$.

A groove pattern P may be formed on the upper surface of the top pad layer 100. The groove pattern P may include a plurality of protrusions R and a plurality concave grooves C that are alternately arranged. The groove pattern P may function to maintain and renew a chemical agent for polishing the surface of the wafer, such as slurry, deionized water, etc. The groove pattern P may have various shapes determined by a pitch, a width, a depth, etc., of the concave grooves C.

The top pad layer 100 may further include a supporting portion arranged under the groove pattern P to support the groove pattern P. The top pad layer 100 may have an overall thickness of about 0.5 mm to about 5 mm inclusive of the groove pattern P. The depth $Thk_{grv}$ of the groove pattern P, i.e., a depth of the concave groove C, may be about 0.1 mm to about 3 mm. The width of the concave groove C may be about 0.1 mm to about 2.0 mm. The depth $Thk_{grv}$ of the groove pattern P may correspond to a thickness of the groove pattern P.

Figure 3:
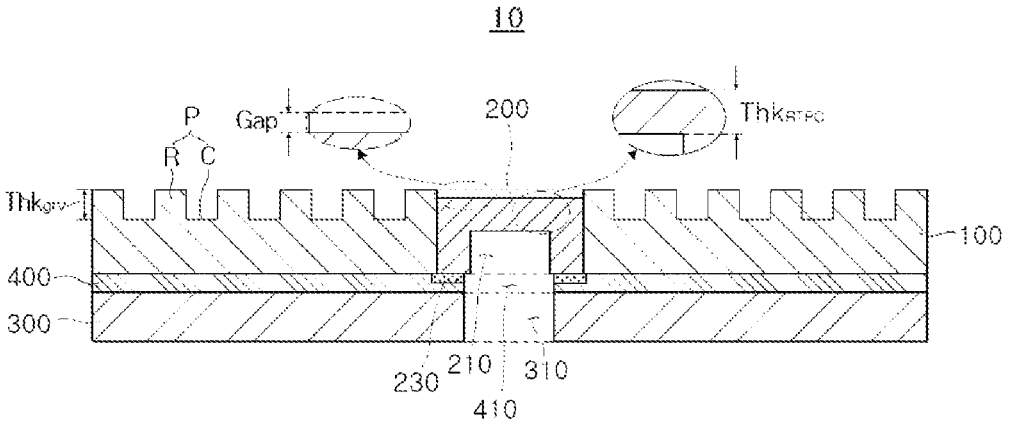
FIG. 3 is a cross-sectional view illustrating a polishing pad in accordance with an embodiment of the disclosure.
Figure 4:
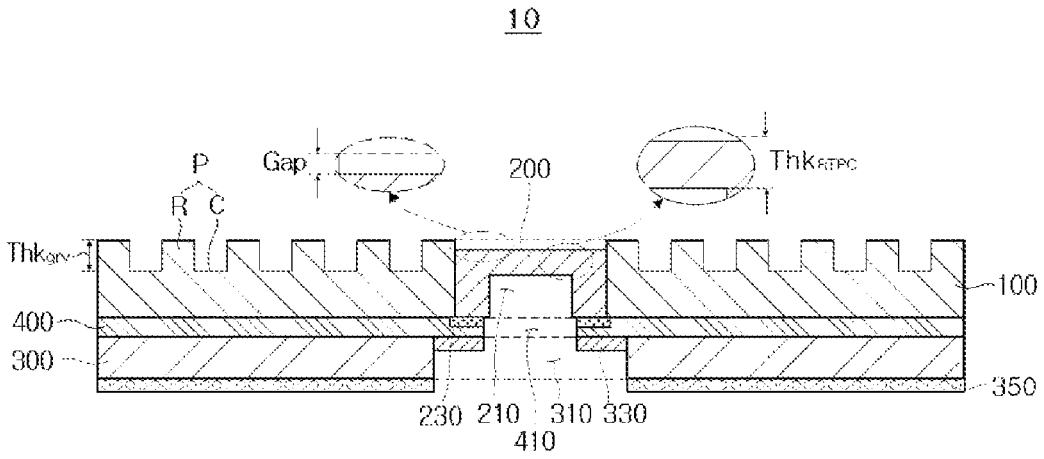
FIG. 4 is a cross-sectional view illustrating a polishing pad in accordance with an embodiment of the disclosure.

In FIGS. 2 to 4, the groove pattern P may include the protrusions R and the concave grooves C that are alternately arranged in concentric circles from a center portion, but embodiments of this disclosure are not limited thereto. For example, the groove pattern P may include protrusions R and concave grooves C that are linearly and alternately arranged without reference to the window block 200. The groove pattern P may include protrusions R and concave grooves C repeatedly arranged like comb pattern. In other embodiments, the groove pattern P may include annular protrusions R and annular concave grooves C concentrically arranged around the window block 200. Further, the groove pattern P may each include a complex shape rather than a single shape.

The window block 200 may be inserted into the first hole 110 of the top pad layer 100.

The window block 200 may include a material that allows a high degree of light transmission and that has few or no bubbles or cavities that impede high light transmittance. The material may be selected to prevent moisture from infiltrating into the window block 200, which results in improved detection accuracy of the end point detection process and prevents damage of the light transmission region.

The light transmittance of the window block 200 may be about 60% to about 90%. The reflectivity of the window block 200 may be about 1.45 to about 1.60. For example, when the thickness of the window block 200 may be about 2.4 mm, the light transmittance of the window block 200 may be about 65% to about 75% and the reflectivity of the window block 200 may be about 1.53 to about 1.57.

The window block 200 may be surface-treated to have a roughness of the upper surface of about 2.0 μm to about 4.0 μm.

The surface treatment may prevent an error of the end point detection caused by wear of the window block 200 in a chemical mechanical polishing (CMP) process. The surface treatment may provide the window block 200 with the above-mentioned range of the roughness using various processes. For example, the surface treatment may be performed using sandpaper at a speed of about 100 rpm to about 1,000 rpm under a pressure of about 0.1 psi to about 3.0 psi to achieve a desired surface roughness.

The window block 200 may have a wear rate that is substantially equal to or slightly higher than a wear rate of the top pad layer 100. Thus, after performing the CMP process, the top pad layer 100 and the window block 200 may be removed together to prevent scratching of the wafer that may be caused by a protrusion of the window block 200.

The window block 200 may have a planar area that is substantially the same as the area of the first hole 110. The window block 200 may have an overall thickness of about 0.2 mm to about 5 mm.

As shown in FIG. 2, the upper surface of the window block 200 may be lower than the upper surface of the top pad layer 100 so that the polishing pad 10 may have a gap around a first hole 110. Alternatively, the upper surface of the window block 200 may be substantially coplanar with the upper surface of the top pad layer 100 so that the polishing pad 10 may not have a gap. That is, the Gap may correspond to a height difference between the upper surface of the window block 200 and the upper surface of the top pad layer 100. The Gap may be about 0.001 mm to about 2 mm.

The window block 200 may include a recess 210. The recess 210 may be formed at a lower surface of the window block 200. The recess 210 may provide the window block 200 with a thinner upper thickness common to the first hole 110 to increase the detection accuracy of the end point detection. The recess 210 may have a depth of about 0.1 mm to about 4 mm. The $Thk_{RTPC}$ in Formula 1, i.e., the thickness of an upper portion of the window block 200, may be a distance between an inner surface of the recess 210 and the upper surface of the window block 200.

The polishing pad 10 may include the top pad layer 100 and the window block 200 and may have a structure defined by Formula 1 to optimize the service life of the polishing pads 10 and to decrease the consumption rate of the polishing pads 10.

The 'Gap' in Formula 1 may be the height difference between the upper surface of the top pad layer 100 and the upper surface of the window block 200. The '$Thk_{RTPC}$' in Formula 1 may be the thickness of an upper portion of the window block 200. The '$Thk_{grv}$' in Formula 1 may be the depth of the groove pattern P.

When the polishing pad 10 is used beyond its expected service life, the groove pattern P may be worn and the window block 200 may be broken so that the slurry, the deionized water, etc., may leak. Furthermore, when the window block 200 is broken, this leakage may cause a failure of the CMP apparatus and may result in an abnormal wafer.

When a gap does not exist between the window block 200 and the top pad layer 100, the wafer may be damaged by the window block 200, which also generates failures. In addition, when an excessive gap is formed between the window block 200 and the top pad layer 100, or any other deviation that creates a leak path between them, the slurry or the deionized water may be leak and result in thickness errors in the wafer.

In contrast, embodiments of the disclosure include polishing pads 10 with a proper gap without leak pathways. The polishing pad may be designed using Formula 1 to obtain the optimal life for the polishing pads 10. Waste is reduced by reducing the number of exchanges of the polishing pad 10 that may have a remaining serviceable life for a new polishing pad.

Particularly, an optimal life time of a new polishing pad 10 may be calculated using the depth of the groove pattern P ($Thk_{grv}$) and the upper portion thickness ($Thk_{RTPC}$) of the window block 200. An optimal life time of the used polishing pad 10 may be inferred from remaining thicknesses of the groove pattern P and the window block 200 after the polishing pad 10 is put into service. Thus, by monitoring these parameters, the polishing pad 10 may be used for its optimal life time without leakage, which decreases the consumption rate of the polishing pad 10.

According to an embodiment, the polishing pad is designed so that the sum of the Gap value and the $Thk_{RTPC}$ value is 1.1 to 3.0 times of the $Thk_{grv}$ value, and, as a result, the polishing pad 10 can be fully used within an appropriate use time. Preferably, the gap between the window block 200 and the top pad layer 100 may be uniform to accurately calculate the end point detection.

An optimal life time of a conventional polishing pad may be reached when the depth of the groove pattern decreases to about 80% of an initial depth of the groove pattern. For example, if the depth of the groove pattern is about 1 mm, then the polishing pad may be used until the depth of the groove pattern is about 0.2 mm. Here, the groove pattern at an edge portion of the polishing pad may be more worn than inner portions. Thus, the optimal life time of the polishing pad may be determined when the average depth of the groove pattern is about 0.2 mm to about 0.35 mm.

Thus, to prevent damage to the window block 200 during the life time of the polishing pad 10, a value obtained by dividing the sum of the thickness of the upper portion of window block 200 and the Gap by the depth of the groove pattern may proportionally express the optimal life time of the window block 200 in the polishing pad 10. The inventors have verified that the probability of breakage in the window block 200 is highest when the thickness of the upper portion of the window block 200 is about 200 μm to about 350 μm.

Therefore, the polishing pad 10 should be used until the thickness $Thk_{RTPC}$ of the window block 200 is 0.2 mm to about 0.35 mm. The polishing pad 10 may then be exchanged for a new one when the thickness $Thk_{RTPC}$ of the window block 200 may be about 0.2 mm to 0.35 mm. That is, the optimal life time of the polishing pad 10 may be a point at which the thickness $Thk_{RTPC}$ of the window block 200 may be 0.2 mm to 0.35 mm in the polishing pad 10, with a corresponding Gap used in Formula 1.

The polishing pad 10 may further include a sub-pad layer 300. The sub-pad layer 300 may support the top pad layer 100 to help absorb and distribute impacts applied to the top pad layer 100. The sub-pad layer 300 may include a material having a hardness that is lower than the hardness of the top pad layer 100.

The sub-pad layer 300 may include a second hole 310. The second hole 310 may be formed through a portion of the sub-pad layer 300 corresponding to the first hole 110. The second hole 310 may be connected to the first hole 110 to form a structure configured to detect the end point through the window block 200.

The second hole 310 may have an area that is smaller than the area of the first hole 110. For example, the second hole 310 may have a circular shape having a diameter of about 5 mm to about 95 mm, or an elliptical shape. Alternatively, the second hole 310 may have a quadrangular shape having a lateral length of about 5 mm to about 95 mm and a longitudinal length of about 5 mm to about 95 mm. Thus, the polishing pad 10 may have an opening that allows a viewing angle for accurately measuring the reflectivity of the wafer. For example, in a plan view, the areas of the second hole 310 may be about 0.5 $cm^2$ to 50 $cm^2$, and preferably, about 4 $cm^2$ to about 12 $cm^2$.

The sub-pad layer 300 may have a thickness of about 0.1 mm to about 3.0 mm, and preferably, about 0.4 mm to about 2.0 mm.

The sub-pad layer 300 may be formed using a non-woven fabric or a porous pad. The sub-pad layer 300 may have a porous structure.

The pores in the sub-pad layer 300 may have an open cell structure. The pores in the sub-pad layer 300 may have a shape that extends in a thickness direction of the sub-pad layer 300. A pores formation ratio of the sub-pad layer 300 may be higher than a pores formation ratio of the top pad layer 100. That is, the sub pad layer 300 may have a structure in which more pores are formed than the top pad layer 100.

Referring to FIG. 4, the thermally fused portion 330 may be formed by forming the second through hole 310 and then compressing portions of the sub pad layer 300 adjacent to the second hole 310 towards the window block 200. Thermally fused portion 330 may be formed to overlap with the bottommost surface of the edge portion of the window block 200 in the vertical direction. The thermally fused portion 330 may be formed to have an area and shape sufficient to cover the entire bottommost surface of the edge portion of the window block 200. For example, the thermally fused portion may be spaced apart by a distance of more than 0 and about 10 mm, which may correspond to a diameter of recess 210 of the window block. In particular, it is possible to cover gaps spaced apart by a distance of 0.5 to about 10 mm, or 1 to about 3 mm.

In FIG. 4, the thermally fused portion 330 may be thermally compressed to have a density higher than a density of a non-fused portion in the sub-pad layer 300, to form a structure that prevents the introduction of slurry and deionized water into the top pad layer 100.

A height difference between a lower surface of the thermally fused portion 330 and a lower surface of the non-fused portion may be about 0.1 mm to about 2.0 mm, and preferably 0.5 mm to about 1.5 mm.

The thermally fused portion 330 may be compressed to a thickness so that the infiltration of the slurry into the thermally fused portion 330 may be effectively prevented. As a result, a change of a polishing rate may be effectively decreased.

During performing the CMP process using the polishing pad 10, the sub-pad layer 300 with the thermally fused portion 330 may prevent the infiltration of the slurry and the deionized water into the top pad layer 100. This helps reduce any changes in compression rate of the top pad layer 100, which is prevented from absorbing the slurry and the deionized water, to obtain a more uniform polishing rate.

In FIG. 4, the polishing pad 10 may further include a second adhesive layer 350 arranged on the lower surface of the sub-pad layer 300. The second adhesive layer 350 may include a double-sided tape. The lower surface of the sub-pad layer 300 may be bonded to the platen through the second adhesive layer 350.

Although not illustrated, the thermally fused portion 330 may be formed by compressing a portion of the sub-pad layer 300 with a portion of the second adhesive layer 350 at a temperature of about 100° C. to about 150° C. under a pressure of about 0.01 Mpa to about 5 Mpa for 60 seconds to about 600 seconds.

The polishing pad 10 may further include a first adhesive layer 400 arranged between the top pad layer 100 and the sub-pad layer 300 to bond the top pad layer 100 to the sub-pad layer 300.

The first adhesive layer 400 may include a transparent film having coated an adhesive on both sides, theretofore example.

The first adhesive layer 400 may be formed using a hot-melt adhesive.

The first adhesive layer 400 may have a thickness of about 0.001 mm to about 3 mm. When the thickness of the first adhesive layer 400 is about 0.001 mm to about 3 mm, the first adhesive layer 400 may be melted at a low temperature to have strong adhesion force, thereby attaching the polishing layer to the supporting layer.

A third hole 410 may be formed through the first adhesive layer 400. The third hole 410 may be connected to the first hole 110. In a plan view, the third hole 410 may have an area that is smaller than the area of the first hole 110. When the area of the third hole 410 is smaller than the area of the first hole 110, the first adhesive layer 400 is configured to support the window block 200 inside the first hole 110 to effectively fix the window block 200 to the sub-pad layer 300.

In a plan view, the third hole 410 may have a circular shape having a diameter of about 5 mm to about 95 mm, or an elliptical shape. Alternatively, the third hole 410 may have a quadrangular shape having a lateral length of about 5 mm to about 95 mm and a longitudinal length of about 5 mm to about 95 mm.

The diameter of the third hole 410 may be smaller than the diameter of the first hole 110. The diameter of the third hole 410 may be substantially the same as the diameter of the second hole 310. The diameter of the second hole 310 may be about 10% to about 95% of the diameter of the first hole 110.

The second hole 310 and the third hole 410 may be aligned with each other. The second hole 310 and the third hole 410 may be formed simultaneously to ensure alignment of the second hole 310 and the third hole 410 to each other.

Referring to FIGS. 3 and 4, the polishing pad 10 may further include a third adhesive layer 230. The third adhesive layer 230 may be arranged on the lowermost surface of the window block 200. The third adhesive layer 230 may be attached to an upper surface of the first adhesive layer 400. The third adhesive layer 230 may be partially arranged on the upper surface of the first adhesive layer 400. The third adhesive layer 230 may be formed using a humidity-setting adhesive when the window block 200 is formed in the first hole 110. The third adhesive layer 230 may be internally fused into the first adhesive layer 400 by heating and compressing the third adhesive layer 230. Thus, the third adhesive layer 230 may function as a high-density region in the first adhesive layer 400. The third adhesive layer 230 may be fused with the first adhesive layer 400. The third adhesive layer 230 may prevent leakage between the window block 200 and the first hole 110 by blocking leak paths between the first hole 110 on the one hand, and on the other, recess 210 and second and third holes 310 and 410 in order to increase the sensing accuracy of the window block 200. The third adhesive layer 230 may have a thickness of about 0.01 mm to about 0.5 mm.

As shown in FIG. 2, the polishing pad 10 may include the top pad layer 100, the window block 200, the sub-pad layer 300 and the first adhesive layer 400. The groove pattern P and the first hole 110 may be formed at the top pad layer 100. The window block 200 may be inserted into the first hole 110. The window block 200 may include the recess 210. The sub-pad layer 300 may be arranged below the lower surface of the top pad layer 100. The second hole 310 may be formed through the sub-pad layer 300. The first adhesive layer 400 may be arranged between the top pad layer 100 and the sub-pad layer 300. The third hole 410 may be formed through the first adhesive layer 400.

FIG. 3 is a cross sectional view illustrating a polishing pad in accordance with an embodiment of the disclosure. Referring to FIG. 3, a polishing pad 10 may include a top pad layer 100, a window block 200, a sub-pad layer 300, a first adhesive layer 400 and a third adhesive layer 230. The groove pattern P and the first hole 110 may be formed in the top pad layer 100. The window block 200 may be inserted into a first hole 110. The window block 200 may include a recess 210. The sub-pad layer 300 may be arranged beneath the lower surface of the top pad layer 100. A second hole 310 may be formed through the sub-pad layer 300. The first adhesive layer 400 may be arranged between the top pad layer 100 and the sub-pad layer 300. A third hole 410 may be formed through the first adhesive layer 400. The third adhesive layer 230 may be arranged on the lowermost surface of the window block 200.

FIG. 4 is a cross sectional view illustrating a polishing pad in accordance with an embodiment of the disclosure. Referring to FIG. 4, a polishing pad 10 may include a top pad layer 100, a window block 200, a sub-pad layer 300, a first adhesive layer 400 and a second adhesive layer 350. A groove pattern P and a first hole 110 may be formed in the top pad layer 100. The window block 200 may be inserted into the first hole 110. The window block 200 may include a recess 210. The sub-pad layer 300 may be arranged beneath the lower surface of the top pad layer 100. A second hole 310 may be formed through the sub-pad layer 300. The sub-pad layer 300 may include a thermally fused portion 330. The thermally fused portion 330 may be disposed at or near the top of second hole 310, and may be disposed to overlap, in the vertical direction, the lowermost portion of the window block 200 and laterally adjacent portions of top pad layer 100. The first adhesive layer 400 may be arranged between the top pad layer 100 and the sub-pad layer 300. The third hole 410 may be formed through the first adhesive layer 400. The third adhesive layer 230 may be arranged on the lower surface of the window block 200.

According to embodiments of the disclosure, the polishing pads 10 that have the above-mentioned structures may exhibit the following effects with respect to problems caused by conventional polishing pads.

In the conventional polishing pad, when a gap Gap does not exist between the window block 200 and the top pad layer 100, the wafer may be damaged by the window block 200. Further, when an excessive gap is formed between the window block 200 and the top pad layer 100, or when a deviation between the window block 200 and the top pad layer 100 is enough to create a leak path, leakage may cause sensing errors. In contrast, the polishing pad 10 of embodiments disclosed herein include a Gap between the window block 200 and the top pad layer 100, and the gap between the window block 200 and the top pad layer 100 in the polishing pad 10 may be constantly controlled to stably sense the metal layer at the initial step of the CMP process.

Further, the leakage of water and air may be generated by the design and the fabrication processes, and leakage between the top pad layer 100 and the window block 200 may generate errors of the RTPC sensor. To remedy these problems, the polishing pad 10 may be manufactured by the thermal fusion and by adhesion processes, using the two adhesives to prevent the leakage of the water and the air.

In order to prevent the damage of the wafer caused by a broken window block 200, a polishing pad having remaining life may be exchanged for new one, which increases the consumption rate of the polishing pad. The proper life time of the polishing pad 10 may be calculated from Formulas 1 to 3 (defined below) to decrease the consumption rate of the polishing pad 10.

When the CMP process is performed using the polishing pad 10, the window block 200 may be easily broken when the thickness of the window block 200 is from 200 μm to about 350 μm. Thus, the optical thickness of the window block 200 may be deduced.

When the polishing pad 10 defined by Formula 1 is manufactured using the Gap between the upper surfaces of the top pad layer 100 and the window block 200, the thickness $Thk_{RTPC}$ of the window block 200, the depth $Thk_{grv}$ of the groove pattern at the top pad layer 100, the optimal life time of the polishing pad 10 may be more accurately predicted.

In some embodiments, the top pad layer 100 and the window block 200 of the polishing pad 10 may have a structure defined by the following Formula 2.

$$1.1 \leq \frac{\text{Gap} + Thk_{RTPC}}{Thk_{grv}} \leq 1.9 \qquad \text{Formula 2}$$

In some embodiments, the top pad layer 100 and the window block 200 of the polishing pad 10 may have a structure defined by the following Formula 3.

$$1.6 \leq \frac{\text{Gap} + Thk_{RTPC}}{Thk_{grv}} \leq 1.9$$

A polishing pad 10 having the above-mentioned structure may be used in various technologies for measuring the end point detection of the CMP process.

The measurement of the end point detection may utilize an optical microscope method using a light source to measure thickness changes, a current detection method of a driving motor using a frictional force, or an eddy current detection method using an induced electromotive force of a metal. The end point detection of the polishing pad 10 may be measured using the above-mentioned three methods. The eddy current detection method, which may detect an eddy current to terminate the CMP process at a desired thickness, i.e., the RTPC method, may be applied to the polishing pad 10.

More particularly, when a gap exists between a signal detection sensor and a wafer, an RTPC type magnetic signal measurement method may generate an unstable signal in accordance with a height of the gap, states of the slurry and the deionized water, etc., to generate an error in a thickness of an initial layer. Thus, it may be important to set the height of the gap and the overall uniformity of the gap. The polishing pad 10 in embodiments of the disclosure may be capable of preventing leakage and accurately measuring a copper layer in the initial CMP process so that the polishing pad 10 may be readily used in RTPC type magnetic signal measurement methods.

The conventional polishing pad manufactured by a thermal fusion may have a strong bonding force between layers. However, leaks may be easily generated in the conventional polishing pad. Further, the conventional polishing pad manufactured using an adhesive may have good vapor permeability resistance. In contrast, because a height difference between the window block and the top pad layer may be irregular, the conventional polishing pad may have low sensing accuracy.

In contrast, the polishing pad 10 of embodiments of the disclosure may be manufactured while simultaneously using both the bonding method and the fusion method applied to the third adhesive layer to prevent the leakage and to have improved sensing accuracy.

The polishing pad 10 of embodiments of the disclosure, which may include a top pad layer 100 and a window block 200, and which may be defined by any of Formulas 1 to 3, may be manufactured by following processes.

The polishing pad 10 may be manufactured by installing a window block 200 at a first hole, arranging a gap-controlling film on a surface of the window block 200 and pressing the gap-controlling film.

For example, the gap-controlling film may be arranged on a lower pressing pad of a compressor including an upper supporting pad. The window block may be inserted into the first hole of the top pad layer. The top pad layer with the window block may be reversed. The reversed top pad layer with the window block may then be loaded into the compressor. The window block may be arranged on the gap-controlling film on the lower pressing pad. The lower pressing pad may compress the top pad layer with the window block. The top pad layer 100 with the window block may be separated from the compressor to complete a polishing pad having a gap corresponding to the thickness of the gap-controlling film.

Alternatively, the gap-controlling film may be arranged on the upper surface of the window block 200. The window block 200 with the gap-controlling film may be inserted into the first hole 110. The upper surface of the gap-controlling film may be pressed until the upper surface of the gap-controlling film is substantially coplanar with the upper surface of the top pad layer 100. The gap-controlling film may then be removed from the window block 200. Further, the gap-controlling film may be arranged on the upper surface of the window block 200 in the first hole 110.

The polishing pad 10 having a gap, which may be the height difference between the upper surface of the top pad layer and the upper surface of the window block, may be easily manufactured in great quantity. Further, the gap in the polishing pad may have a low level of manufacturing deviation and a uniform structure.

Particularly, the polishing pad 10 manufactured by the above-mentioned methods may have the gap (the height difference between the upper surface of the top pad layer and the upper surface of the window block) of about 0.001 mm to about 2 mm, an RTPC time variability of about ±1% to about 30% and a gap variability of about 10% to about 40%.

Preferably, the polishing pad 10 of example embodiments may have the gap of about 0.001 mm to about 0.5 mm, an RTPC time variability of about ±5% to about 15% and a gap variability of about 25% to about 35%. The variability may be illustrated later in detail with reference to following Examples.

The polishing pad 10 having an above-mentioned structure may have low dispersion with respect to a polishing time and a high analysis value of a process capacity to have a predicted fraction defective of the CMP process of no more than about $5.7\times10^{-5}$, thereby having good yield rate.

Thus, the gap-controlling film may have a thickness of about 0.001 mm to about 0.1 mm. The gap-controlling film may include at least one film to control the gap.

In a method of manufacturing the polishing pad 10 of embodiments of the disclosure, a first hole 110 may be formed through the top pad layer 100 with a groove pattern P. A window block 200 may be formed in the first hole 110 to form a polishing pad 10 including the top pad layer 100 and the window block 200. The top pad layer 100 and the window block 200 may have a structure defined by the following Formula 1.

$$1.1 \le \frac{\text{Gap} + Thk_{RTPC}}{Thk_{grv}} \le 3.0 \qquad \text{Formula 1}$$

In Formula 1, the Gap may indicate a height difference between an upper surface of the top pad layer 100 and an upper surface of the window block 200, the $\text{Thk}_{RTPC}$ may indicate a thickness of an upper portion of the window block 200, and the $\text{Thk}_{grv}$ may indicate a depth of a groove pattern formed at the upper surface of the top pad layer 100.

In embodiments, the top pad layer and the window block of the polishing pad 10 may have a structure that is defined by the following Formula 2.

$$1.1 \le \frac{\text{Gap} + Thk_{RTPC}}{Thk_{grv}} \le 1.9 \qquad \text{Formula 2}$$

The top pad layer and the window block of the polishing pad 10 may have a structure defined by the following Formula 3.

$$1.6 \le \frac{\text{Gap} + Thk_{RTPC}}{Thk_{grv}} \le 1.9$$

Figure 5:
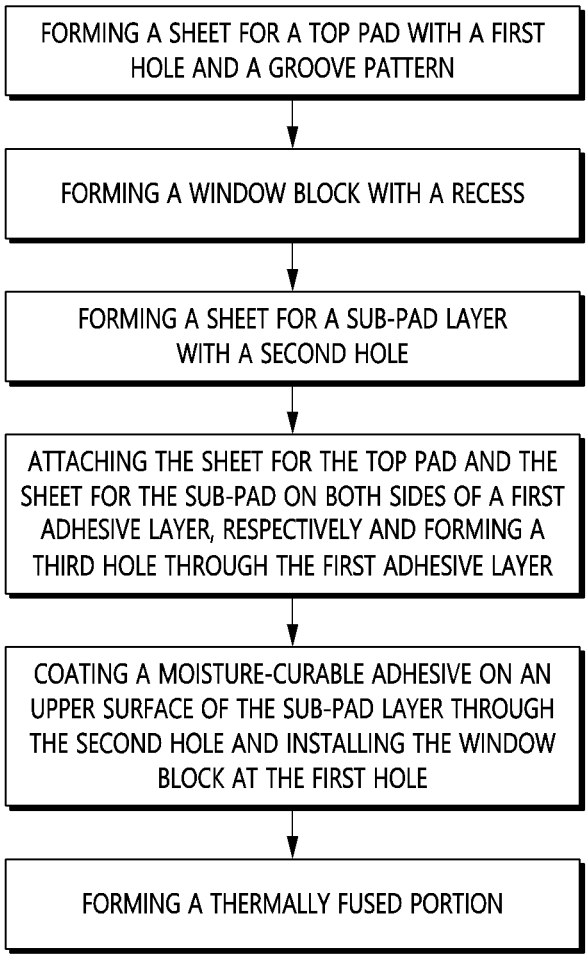
FIG. 5 illustrates a method of manufacturing a polishing pad in accordance with an embodiment of the disclosure.

FIG. 5 illustrates a method of manufacturing a polishing pad in accordance with an embodiment of the disclosure. The method of manufacturing the polishing pad may include forming a first hole through a sheet of material for the top pad layer. The first hole may be formed through a central portion of the sheet to have a set or predetermined size or area.

The first hole 110 may be formed by a press, a punch, or a polishing process using a cutting tool. Alternatively, the first hole 110 may be formed by pouring a material into a mold having a shape corresponding to the shape of the first hole 110 and then hardening the material.

The method of manufacturing the polishing pad may include installing the window block at the first hole to form the polishing pad including the top pad layer and the window block.

The window block may be formed with a recess and may be installed in the first hole. The gap-controlling film may be arranged on the surface of the window block. The upper surface of the gap-controlling film may then be pressed.

For example, the gap-controlling film may be arranged on a lower pressing pad of a pressor. The window block may be inserted into the first hole of the top pad layer. The top pad layer with the window block may be reversed. The reversed top pad layer with the window block may then be loaded onto the pressor. The window block may be arranged on the gap-controlling film on the lower pressing pad. The lower pressing pad may press the top pad layer with the window block. The top pad layer with the window block may be separated from the pressor to complete the polishing pad having a gap (the height difference between the upper surface of the top pad layer and the upper surface of the window block) that corresponds to the thickness of the gap-controlling film.

Alternatively, the gap-controlling film may be arranged on the upper surface of the window block 200. The window block with the gap-controlling film may be inserted into the first hole 110. The upper surface of the gap-controlling film may be pressed to position the upper surface of the gap-controlling film to be substantially coplanar with the upper surface of the top pad layer 100. The gap-controlling film may then be removed from the window block. Further, the gap-controlling film may be arranged on the upper surface of the window block in the first hole.

The above-mentioned methods may include forming the basic structure of a polishing pad including a top pad layer 100 and a window block 200. The methods of disclosed embodiments may further include forming the first adhesive layer 400 and the sub-pad layer 300 on the lower surface of the top pad layer 100.

In embodiments of the disclosure, the method may include forming the first hole through a sheet of material for the top pad layer with the groove pattern. A sheet of material for the sub-pad layer may be bonded to the lower surface of the sheet for the top pad layer to form a bond structure that includes the sub-pad layer, the first adhesive layer and the top pad layer, sequentially stacked. A third hole may be formed through the first adhesive layer. A moisture-curable adhesive may be coated on an upper surface of the first adhesive layer. A window block may be installed in the first hole of the bond structure.

The bond structure may be formed by arranging the sheet with the second hole for the sub-pad layer on the lower surface of the sheet for the top pad layer, and by coating the adhesive between the sheets. In a plan view, the area of the second hole may be smaller than the area of the first hole. The second hole may be formed in the same manner used for forming the first hole. When the top pad layer 100 and the sub-pad layer 300 are bonded to each other, the first hole 110 of the top pad layer 100 and the second hole 310 of the sub-pad layer 300 may be aligned with each other in a plan view.

The sheet for the top pad layer and the sheet for the sub-pad layer may be attached to each other using the adhesive. The attachment may take place at no less than a melting point of the adhesive for the first adhesive layer. The adhesive may include a hot-melt adhesive. The attachment may be performed at a temperature of about 90° C. to about 130° C.

After forming the bond structure, the third hole may be formed through the first adhesive layer. In a plan view, the area of the third hole may be substantially the same as the area of the second hole. The first hole 110, the second hole 310 and the third hole 410 may be aligned with each other.

The moisture-curable adhesive may coat the upper surface of the first adhesive layer. Because the size of the second and third holes may be smaller than the area of the first hole, the upper surface of the first adhesive layer may be partially exposed. The moisture-curable adhesive may be coated on the exposed portion of the first adhesive layer. The window block may be arranged in the first hole and the window block may be fixed to the first adhesive layer. The polishing pad may include an adhesive layer formed of the moisture-curable adhesive.

The window block 200 may be attached to the sub-pad layer 300 by thermal pressing. For example, after inserting the window block 200 into the first hole, the first adhesive layer 400 may attach the window block 200 to the sub-pad layer 300 by thermal pressing through the window block 200.

Further, before inserting the window block 200, the third adhesive layer 230 (see FIG. 3) may be arranged on the lower surface of the window block 200. That is, the window block 200 with the moisture-curable adhesive may be inserted into the first hole 110. The third adhesive layer 230 may reinforce an adhesion force between the window block 200 and the sub-pad layer 300. The third adhesive layer 230 may be hardened when the window block 200 is installed in the first hole 110 to fuse the first adhesive layer 400 by thermal pressing. Thus, a region having a high density may be formed in the first adhesive layer 400.

The method of manufacturing the polishing pad 10 may further include forming a thermally fused portion on the sub-pad layer 300.

In embodiments of the disclosure, the thermally fused portion 330 may formed through thermal pressing. For example, the thermally fused portion 330 may be formed at a temperature of about 100° C. to about 150° C. under a pressure of about 0.1 MPa to about 5 MPa. The thermally fused portion 330 may be formed at the region corresponding to an outer peripheral region on the lower surface of the window block 200. The sub-pad layer 300 may be partially pressed to form the thermally fused portion 330. The thermally fused portion 330 may have a high density that prevents leakage.

The polishing pad 10 may have improved sealing characteristics against moisture due to good sealing between the top pad layer 100 and the window block 200, thereby suppressing leakage in the CMP process. The sub-pad layer 300 may include the thermally fused portion 330. The thermally fused portion 330 may have low porosity to prevent the leakage of the water and/or the slurry in the polishing solution without an additional leakage-preventing layer.

Although slurry leakage may be generated between the window block 200 and the top pad layer 100, the third adhesive layer 230 may secondarily prevent the slurry leakage. The third adhesive layer 230 may be formed at the sub-pad layer 300 corresponding to the outer peripheral region of the window block 200 to have good leakage-suppressing effect. The sub-pad layer 300 may be readily pressed and easily applied.

In embodiments of the disclosure, a sheet for the top pad layer may include a composition including a urethane-based prepolymer, a hardening agent, a reaction rate regulating agent, a chain extending agent and a pore forming agent.

The urethane-based prepolymer may include a high molecular compound having an NCO end formed by reacting polyhydric alcohol, isocyanate and the chain extending agent with each other. More particularly, the urethane-based prepolymer may be formed by polymerizing a mixture of the polyhydric alcohol containing polytetramethylene glycol, the hardening agent containing toluene diisocyanate and hexamethylene diisocyanate, the chain extending agent containing butanediol, the reaction rate regulating agent containing tertiary amine such as triethylenediamine and the pore forming agent. The urethane-based prepolymer may have a mean molecular weight of about 800 g/mol to about 1,000 g/mol. The pore forming agent may include a material for forming pores in the sheet for the top pad layer such as a solid pore forming agent, a liquefied pore forming agent, an inert gas, etc.

The sheet for the top pad layer may include a groove pattern formed on the upper surface of the sheet. The groove pattern may be formed by mechanical polishing, a forming process using a mold, etc., and methods are not limited to the above examples.

Therefore, the sheet for the top pad layer may have a structure including the groove pattern configured to facilitate flow of the polishing solution and the pores may be configured to assist in the flow to a smaller degree.

The window block may include a composition containing a urethane-based prepolymer, a hardening agent and a reaction rate regulator. The urethane-based prepolymer may include materials substantially the same as those for the top pad layer. A content of the hardening agent may be controlled to adjust hardness, thereby controlling a wear rate of the CMP process, i.e., loss probability.

The window block 200 may further include a recess 210 formed at a central portion of the window block 200. The recess 210 may be formed by a router, a cutting, a compression, etc.

The sub-pad layer 300 may support the top pad layer 100. The sub-pad layer 300 may absorb and distribute an impact applied to the top pad layer 100. The sub-pad layer 300 may have hardness that is lower than the hardness of the top pad layer 100.

In embodiments of the disclosure, the sub-pad layer 300 may be formed using a sheet for the sub-pad layer. The sheet for the sub-pad layer may be formed of a composition containing a non-woven fabric or a urethane-based prepolymer.

The first adhesive layer may include general adhesives for attaching sheets to each other. The first adhesive layer may include a hot-melt adhesive. Particularly, the hot-melt adhesive may include a polyurethane-based resin, a polyester-based resin, an ethylene-acetate vinyl-based resin, a polyamide-based resin, a polyolefin-based resin, a combination thereof, etc.

The first adhesive layer 400 may include the hot-melt adhesive having a melting point of about 110° C. to about 130° C. When the melting point of the first adhesive layer 400 is within the above range, the first adhesive layer 400 may have strong adhesion force and may prevent peeling between the top pad layer and the sub-pad layer and deformation and deterioration of the top pad layer and/or the sub-pad layer.

The moisture-curable adhesive, that is, the third adhesive may be cured by moisture in air.

The method of manufacturing the polishing pad may further include forming a second adhesive layer 350 on the lower surface of the sub-pad layer 300. The second adhesive layer 350 may include double-sided tape. The second adhesive layer 350 may attach the lower surface of the sub-pad layer 300 to the platen.

The second adhesive layer may be formed of a film for a sub-pad layer and may be formed with an opening common to the second hole. Alternatively, a hole common to the second hole may be formed in the second adhesive layer after the film attached to the lower surface of the sub-pad layer. The film for forming the second adhesive layer may be a film in which an adhesive is coated on both sides. Alternatively, the film for forming the second adhesive layer may be a film using the same structure except attached a releasing film on one side.

Example 1

A polishing sheet was manufactured using the method in FIG. 5.

(1) Manufacturing a Sheet for a Top Pad Layer

A casting apparatus included a mixture supply line of a urethane-based prepolymer, a hardening agent and a solid pore forming agent. The urethane-based prepolymer containing a 9% by weight of a non-reacted NCO was supplied to a prepolymer tank of the casting apparatus. A bis(4-amino-3-chlorophenyl) methane (MOCA) was supplied to a hardening agent tank. A 3% by weight of the solid pore forming agent with respect to a 100% by weight of the urethane-based prepolymer was supplied to the prepolymer tank.

The urethane-based prepolymer and the MOCA were supplied and agitated into a mixing head. A ratio of a molecular equivalent of an NCO group of the urethane-based prepolymer to a molecular equivalent of a reactive group of the hardening agent was 1:1. The urethane-based prepolymer and the MOCA were supplied at a speed of 10 kg/min.

The agitated material was then supplied to a pre-heated mold of a temperature of 120° C. The material was formed using the mold to form a porous polyurethane sheet for the top pad layer. A surface of the porous polyurethane sheet was ground using a grinder. A groove pattern having a thickness $Thk_{grv}$ was formed at the porous polyurethane sheet using a tip.

(2) Manufacturing a Window Block

A urethane-based prepolymer and a hardening agent were supplied to a mold having a lateral length of 1,000 mm, a longitudinal length of 1,000 mm and a height of 50 mm to form a cake for the window block. The same hardening agent was used to manufacture the sheet for the top pad layer for manufacturing the window block.

The urethane-based prepolymer was different from the urethane-based prepolymer used for manufacturing the sheet for the top pad layer. The urethane-based prepolymer used for the cake includes an 8.5% by weight of a non-reacted NCO produced by PUGL-500D of SKC Company.

The cake was cut and blanked to form a molded article having a size of 20 mm×60 mm×2.0 mm. The molded article was installed at a router. A recess was then formed at the molded article using the router to form the window block. The recess had a size of 12.5 mm×31.0 mm×1.0 mm. A distance between an inner surface of the recess and an upper surface of the window block, i.e., a thickness $THK_{RTPC}$ was 1.0 mm.

(3) Manufacturing a Sub-Pad Layer

A sheet material having a thickness of 1.3 mm produced by ND-5400H of PTS was used to form a sheet for the sub-pad layer having a size of 1,000 mm×1,000 mm. A second hole having a size of 16 mm×56 mm was formed through the sheet for the sub-pad layer.

(4) Manufacturing a Polishing Pad

A first hole having a size of 20 mm×60 mm was formed through the sheet for the top pad layer. A hot-melt film was attached to the surface of the sheet for the sub-pad layer. The hot melt film was produced by TF-00 of SKC Company having an average thickness of 40 μm and a reflectivity of 1.5. Double-sided tape was then attached to the other surface of the sheet for the sub-pad layer. The sheets for the top pad layer and sub-pad layer were heated to a temperature of 120° C. to thermally fuse the sheets using the hot-melt film to form a four layers in a bond structure. The bond structure included the top pad layer, the sub-pad layer, the first adhesive layer having a thickness of 1.5 mm between the top pad layer and the sub-pad layer and a second adhesive layer attached to the lower surface of the sub-pad layer.

A second hole and a third hole each having a size of 16 mm×56 mm were formed through the first adhesive layer, the sub-pad layer and the second adhesive layer in alignment with the first hole. A hole having a size same as the size of the second hole was formed through the second adhesive layer.

Figure 6A:
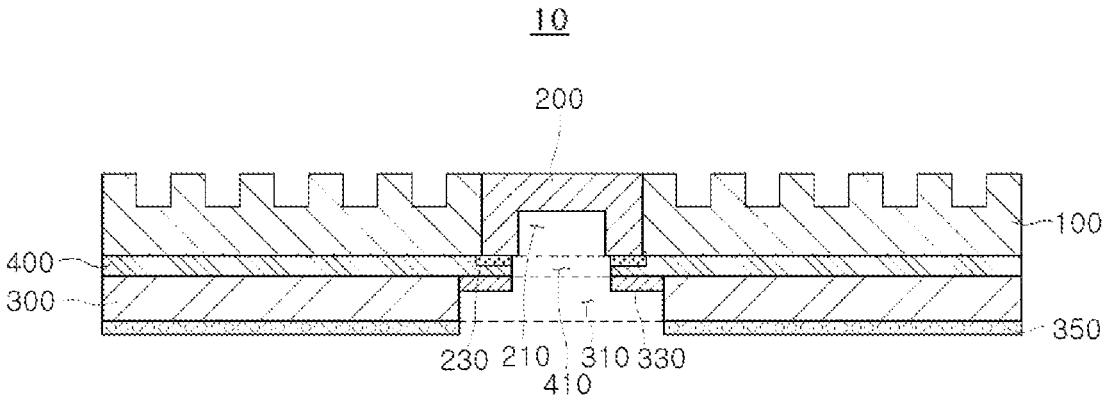
FIGS. 6A and 6B are a cross-sectional view illustrating a polishing pad manufacturing by Example Embodiment 1 and Example Embodiments 2 to 6.

A moisture-curable adhesive was coated on the upper surface of the sub-pad layer between the first hole and the second hole. The window block was inserted into the first hole of the top pad layer. The lower surface of the window block was thermally fused with the sub-pad layer to attach the window block to the sub-pad layer, thereby manufacturing the polishing pad in FIG. 4. The thermal fusion was performed at a temperature of 130° C. under a pressure of 0.5 MPa for three minutes. The upper surfaces of the window block and the top pad layer in the polishing pad were coplanar with each other so that a gap did not exist between the upper surfaces of the top pad layer and the window block in FIG. 6A.

Example 2

Figure 6B:
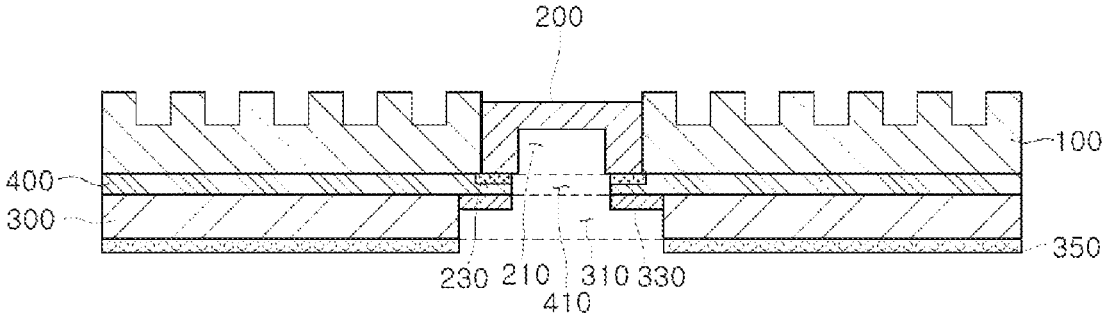

A polishing pad having a gap of 50 μm in FIG. 6B was manufactured by processes used for manufacturing the polishing pad in Example 1 except for using a gap-controlling film. The gap-controlling film having a thickness of 50 μm was attached to the upper surface of the window block to form a window block structure. The first hole was formed through the window block structure. The window block structure was then pressed. The gap-controlling film was removed to form the gap between the upper surfaces of the window block and the top pad layer.

Example 3

A polishing pad having a gap of 150 μm in FIG. 6B was manufactured by processes used for manufacturing the polishing pad in Example 2 except for using a gap-controlling film having a thickness of 150 μm.

Example 4

A polishing pad having a gap of 250 μm in FIG. 6B was manufactured by processes used for manufacturing the polishing pad in Example Embodiment 2 except for using a gap-controlling film having a thickness of 250 μm.

Example 5

A polishing pad having a gap of 100 μm was manufactured by processes used for manufacturing the polishing pad in Example Embodiment 2 except for using a window block with a recess. The recess had a size of 12.5 mm×31.0 mm×0.6 mm. A distance between the inner surface of the recess and the upper surface of the window block, i.e., the thickness $Thk_{RTPC}$ was 1.4 mm.

Example 6

A polishing pad having a gap of 200 μm was manufactured by processes used for manufacturing the polishing pad in Example Embodiment 5.

Comparative Example 1

Figure 7A:
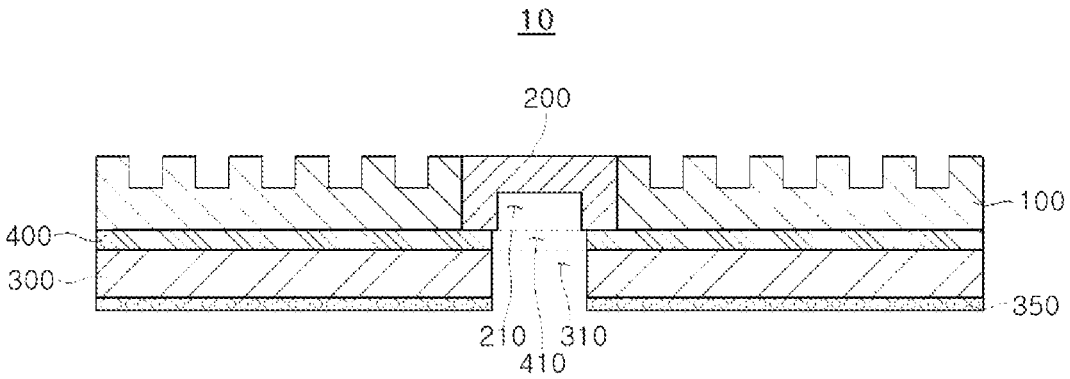
FIGS. 7A and 7B are a cross-sectional view illustrating a polishing pad manufacturing by Comparative Embodiment 1 and Comparative Embodiments 2 to 4.

A polishing pad without a gap in FIG. 7A was manufactured by processes used for manufacturing the polishing pad in Example 1 except without the moisture-curable adhesive and the thermally fused portion. The window block was attached to the first adhesive layer on the upper surface of the sub-pad layer. The sheet for the top pad layer included the groove pattern having a thickness of 0.75 mm.

Comparative Example 2

A polishing pad with a gap of 50 μm was manufactured by processes used for manufacturing the polishing pad in Comparative Example 1 except for attaching a gap-controlling film having a thickness of 50 μm on the upper surface of the window block to form the window block structure, forming the first hole through the window block structure, pressing the window block structure and removing the gap-controlling film to form the gap between the upper surfaces of the top pad layer and the window block.

Comparative Example 3

Figure 7B:
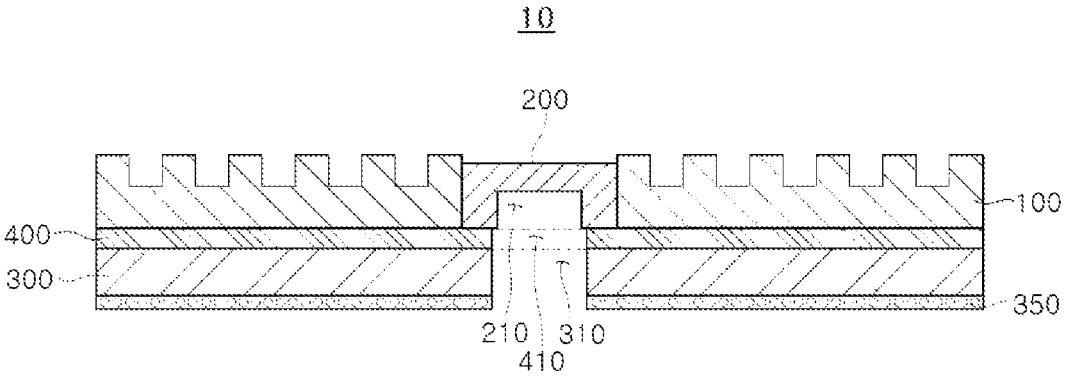

A polishing pad with a gap of 150 μm in FIG. 7B was manufactured by processes used for manufacturing the polishing pad in Comparative Example 2 except for using a gap-controlling film having a thickness of 150 μm.

Comparative Example 4

A polishing pad with a gap of 250 μm in FIG. 7B was manufactured by processes used for manufacturing the polishing pad in Comparative Example 2 except for using a gap-controlling film having a thickness of 250 μm.

Comparative Example 5

Figure 8A:
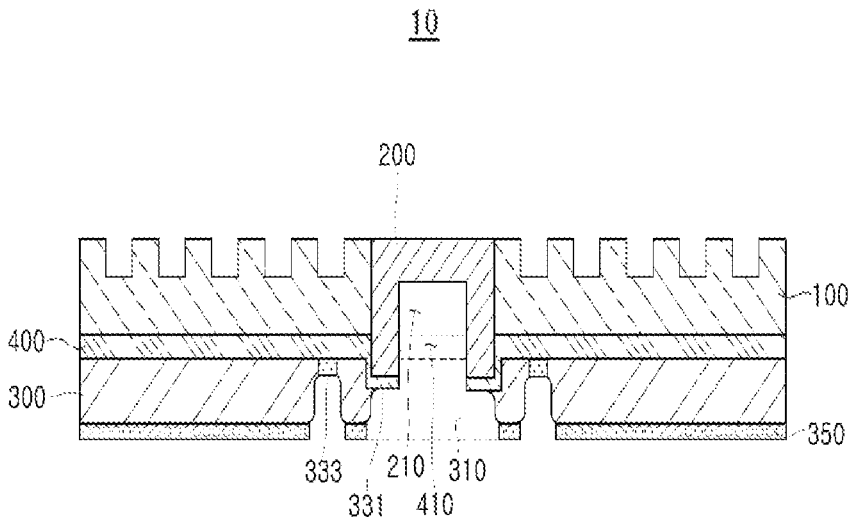
FIGS. 8A and 8B are a cross-sectional view illustrating a polishing pad manufacturing by Comparative Embodiment 5 and Comparative Embodiments 6 to 8.

A polishing pad without a gap in FIG. 8A was manufactured by processes used for manufacturing the polishing pad in Example 1 except for following processes. The first adhesive layer and the window block were attached to the upper surface of the sub-pad layer. The window block was thermally fused to form the polishing pad with a first compression region 331 and a second compression region 333.

Comparative Example 6

Figure 8B:
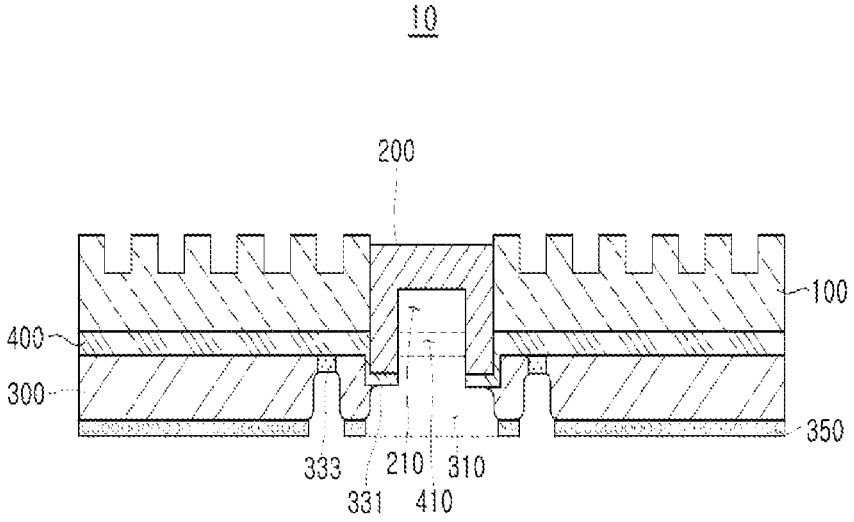

A polishing pad with a gap of 50 μm in FIG. 8B was manufactured by processes used for manufacturing the polishing pad in Comparative Example 5 except for attaching a gap-controlling film having a thickness of 50 μm on the upper surface of the window block to form the window block structure, forming the first hole through the window block structure, pressing the window block structure and removing the gap-controlling block to form the gap between the upper surfaces of the top pad layer and the window block.

Comparative Example 7

A polishing pad with a gap of 150 μm in FIG. 8B was manufactured by processes used for manufacturing the polishing pad in Comparative Example 6 except for using the gap-controlling film having a thickness of 150 μm.

Comparative Example 8

A polishing pad with a gap of 250 μm in FIG. 8B was manufactured by processes used for manufacturing the polishing pad in Comparative Example 6 except for using the gap-controlling film having a thickness of 250 μm.

Experiment 1: Property Evaluation 1

(1) Evaluating Sensitivities at an Initial CMP Process

The polishing pads manufactured in the Examples and Comparative Examples were placed on the platen. The polishing solution including the slurry and the deionized water was supplied to the polishing pads to polish the surface of the wafer. The sensitivities for measuring thicknesses of copper layers on the wafer at the initial CMP process were evaluated as shown in following Table 1.

TABLE 1

| | Gap | $Thk_{RTPC}$ | $Thk_{grv}$ | Formula value | Sensitivity | Water leakage | Air leakage | Groove thickness in damage of window block |
|---|---|---|---|---|---|---|---|---|
| Example 1 | 0 | 1,000 | 850 | 1.1765 | ○ | Good | $3.4 \times 10^{-4}$ | 500 |
| Example 2 | 50 | 1,000 | 850 | 1.2353 | ○ | Good | $2.2 \times 10^{-4}$ | 450 |
| Example 3 | 150 | 1,000 | 850 | 1.3529 | ○ | Good | $1.3 \times 10^{-4}$ | 200 |
| Example 4 | 250 | 1,000 | 850 | 1.4706 | X | Good | $1.2 \times 10^{-4}$ | 150 |
| Example 5 | 100 | 1,400 | 850 | 1.7647 | ○ | Good | $1.4 \times 10^{-4}$ | 0 |
| Example 6 | 200 | 1,400 | 850 | 1.8824 | ○ | Good | $2.4 \times 10^{-4}$ | 0 |
| Comparative Example 1 | 0 | 1,000 | 750 | 1.3333 | ○ | Bad | — | 400 |
| Comparative Example 2 | 50 | 1,000 | 750 | 1.4000 | ○ | Bad | — | 330 |
| Comparative Example 3 | 150 | 1,000 | 750 | 1.5333 | ○ | Bad | — | 200 |
| Comparative Example 4 | 250 | 1,000 | 750 | 1.6667 | X | Bad | — | 0 |
| Comparative Example 5 | 0 | 1,000 | 850 | 1.1765 | ○ | Bad | $2.1 \times 10^{-2}$ | 200 |
| Comparative Example 6 | 50 | 1,000 | 850 | 1.2353 | ○ | Bad | $1.8 \times 10^{-2}$ | 150 |
| Comparative Example 7 | 150 | 1,000 | 850 | 1.3529 | ○ | Bad | $3.5 \times 10^{-2}$ | 180 |
| Comparative Example 8 | 250 | 1,000 | 850 | 1.4706 | X | Bad | $5.1 \times 10^{-2}$ | 110 |

(2) Water Leakage Test

The polishing pads manufactured by Examples and Comparative Examples were placed on the platen. The polishing solution including the slurry and the deionized water was supplied to the polishing pads to polish the surface of the wafer. The leakage of the polishing solution into the top pad layer in each of the polishing pads was evaluated as shown in Table 1.

(3) Air Leakage Test

Air leakage (cc/minute) of the polishing pads manufactured by Examples and Comparative Examples were evaluated in Table 1.

(4) Depths of the Groove Pattern in the Top Pad Layer in Polishing Pad with Damaged Window Block The polishing pads manufactured by Examples and Comparative Examples were placed on the platen. The polishing solution including the slurry and the deionized water was supplied to the polishing pads to polish the surface of the wafer. The polishing process was terminated when the window block was broken. The thicknesses of the groove patterns remaining on the top pad layer were measured as shown in Table 1.

(5) Result 1

It can be noted that the water leakage is not generated in the polishing pads in Examples 1 to 6, which have good leakage-proof capacity. In contrast, it can be noted that the water leakage is generated in the polishing pads manufactured by Comparative Examples 1 to 8, which have bad leakage-proof capacity.

Therefore, it can be noted that the third adhesive layer and the thermally fused portion function to improve the sealing capacity so that the good water leakage-proof capacity is provided to the polishing pads in the Examples.

Further, it can be noted that the air leakage in the polishing pads of the Examples is smaller than the air leakage in the polishing pads of Comparative Examples due to the third adhesive layer and the thermally fused portion.

Furthermore, it can be noted that the window block of each of the polishing pads in the Examples is not broken until the groove pattern is fully removed so that the polishing pads are used through their lifetime.

When characteristics of the polishing pad manufactured by Examples 5 and 6 were evaluated, values calculated by Formula 1 were 1.7647 and 1.8824. Thus, it can be noted that the polishing pad having a structure designed by the value of no less than 1.6 obtained from Formula 1 is successfully used in the CMP process.

Experiment 2: Property Evaluation 2

Capacities of the polishing pads in CMP processes manufactured by Example 5 and Comparative Example 6 were evaluated as shown following Table 2

TABLE 2

| | Comparative Example 6 | Example 5 |
|---|---|---|
| AVG | 32.5" | 32.9 |
| Max | 37" | 34" |
| Min | 27" | 31" |
| RAN | 10" | 3" |
| Cp | 0.70 | 1.76 |
| Cpk | 0.64 | 1.73 |

In Table 2, AVG is an average of the RTPC times, Max is a maximum of the RTPC times, Min is a minimum of the RTPC times, RAN is dispersion, and Cp and Cpk are analysis values of the process capacities. A unit of the RTPC times is a second.

The twenty-three polishing pads of Comparative Example 6 and the eleven polishing pads of Example 5 were prepared. The Cp and the Cpk were obtained using Formulas 1 to 3. When the Cp and the Cpk are no less than 1.33, the capacity of the polishing pad is determined to be good based on Table 3.

$Cp$=allowable dispersion/actual dispersion $Cpk=(1-k)\times Cp$ $K$=difference between a standard center and an average/half of standard width

TABLE 3

| | | Predicted yield | Predicted fraction defective |
|---|---|---|---|
| $1.34 < Cp \leq 1.67$ | Very good | No less than 99.999943% | No more than 0.000057% |
| $1.00 < Cp \leq 1.33$ | good | No less than 99.9937% | No more than 0.0063% |
| $0.68 < Cp \leq 1.00$ | Ordinary | No less than 99.73% | No more than 0.27% |
| $0.00 < Cp \leq 0.67$ | Very bad | No more than 95.45% | No less than 4.5% |

When a metal layer on the wafer may be polishing to a set thickness, the CMP process may be automatically terminated. The RTPC time may represent a time that the thickness of the metal layer may be reduced to the set thickness in polishing the wafers on which the same metal layers may be formed. For example, when a wafer on which a metal layer having a thickness of about 10,000 Å may be formed is polished to have the metal layer having a final thickness of about 3,000 Å, the CMP process may be terminated at the thickness of 7,000 Å in the polished metal layer. Thus, the RTPC time may represent the polishing time.

The same RTPC time may mean that a deviation of the polishing time until the metal layer may have the set thickness under same conditions may not be high or may be same. The range of the RTPC time, i.e., the CMP process and the environmental conditions may be stable in proportion to the smaller dispersion.

A reading of the thickness of the metal layer and a difference between the polishing times may be different in accordance with positions of the gap in the polishing pads. Thus, it may be required to maximumly decrease the range of the gap. The range of the gap may be dependent upon the structure of the window block in the polishing pad. That is, when the gap is increased, the range of the gap may also be increased.

Therefore, the ranges of the RTPC time and the gap may be an important factor affecting the capacity of the CMP process.

An average of the RTPC times in the polishing pad of Example 5 is 32.9 seconds. An average of the RTPC times in the polishing pad of Comparative Example 6 is 32.5 seconds. A maximum and a minimum of the RTPC times in the polishing pad of Example 5 are 34 second and 31 seconds, respectively. A maximum and a minimum of the RTPC times in the polishing pad of Comparative Example 6 are 37 second and 27 seconds, respectively. Thus, a dispersion of the polishing pad in Example 5 is 3 seconds. In contrast, a dispersion of the polishing pad in Comparative Example 6 is 10 seconds. Therefore, the range of the polishing pad in Example 5 is ±5% with respect to the average. In contrast, the range of the polishing pad in Comparative Example 6 is above ±30%. As a result, it can be noted that the polishing pad of Example 5 has a lower range of the RTPC time so that the polishing pad of Example 5 is reliably used.

The Cp and the Cpk of the polishing pad in Example 5 are 1.76 and 1.73, respectively. Thus, it can be noted that the predicted yield of the wafer polished by the polishing pad in Example 5 is very high due to good characteristics of the polishing pad. In contrast, the Cp and the Cpk of the polishing pad in the Comparative Example 6 are 0.70 and 0.64, respectively. Thus, it can be noted that the predicted yield of the wafer polished by the polishing pad in Comparative Example 6 is ordinary or very low due.

Further, the ranges of the gap and the RTPC time in the polishing pad in Example 5 are evaluated. The range of the gap may mean a deviation of the gap in the polishing pad manufactured by same processes. The low range of the gap may indicate a small shape difference between the gaps.

For example, when a designed polishing pad may have a designed gap of about 0.05 mm, an actual polishing pad may have a gap of about 0.035 mm to about 0.065 mm. The actual polishing pad may have about 30% of a gap range. That is, the actual gap may be lower than the target gap by about ±30%.

The polishing pad in Example 5 had a gap of about 0.001 mm to about 0.1 mm to have about a ±30% difference between the actual gap and the target gap so that the range of the RTPC time may be about ±5%. Thus, the polishing pad having the gap of about 0.001 mm to about 0.1 mm may be stably used in the CMP process.

In contrast, the polishing pad in Comparative Example 6 had a gap of about 0.01 mm to about 0.2 mm to have about a ±40% difference between the actual gap and the target gap so that the range of the RTPC time may be about ±15%.

According to examples, the polishing pad having the gap of about 0.01 mm to about 0.1 mm in Example 5 may be more stable and reliable in use when compared with the polishing pad in Comparative Example 6.

As a result, the polishing pads with uniform gaps in the Example may be manufactured in large quantity.

What is claimed is:

1. A polishing pad comprising:

a top pad layer including a groove pattern formed at an upper surface of the top pad layer to a first depth and a first hole formed through the top pad layer;

a window block inserted into the first hole, and disposed to form a first hole gap formed between the upper surface of the top pad layer and an upper surface of the window block;

wherein the top pad layer and the window block satisfy Formula 1:

$$1.1 \leq \frac{\text{Gap} + Thk_{RTPC}}{Thk_{grv}} \leq 3.0,$$

wherein Gap in Formula 1 indicates a height difference between the upper surface of the top pad layer and an upper surface of the window block at the first hole gap, and the Gap in Formula 1 ranges from 0.001 mm to 2 mm, $\text{Thk}_{RTPC}$ indicates a thickness of the window block and $\text{Thk}_{grv}$ indicates a depth of the groove pattern.

2. The polishing pad of claim 1, wherein the depth of the groove pattern is 0.5 mm to 2 mm.

3. The polishing pad of claim 1, wherein a thickness of the top pad layer is 0.5 mm to 5 mm.

4. The polishing pad of claim 1, wherein a thickness of an upper portion of the window block is 0.2 mm to 5 mm.

5. The polishing pad of claim 1, wherein the window block further includes a recess formed at a central portion of a lower surface of the window block.

6. The polishing pad of claim 1, wherein the height difference between the upper surface of the top pad layer and the upper surface of the window block is 0.01 mm to 2 mm.

7. The polishing pad of claim 1, further comprising a sub-pad layer arranged on a lower surface of the top pad layer, the sub-pad layer including a second hole that is formed through a portion of the sub-pad layer corresponding to the first hole.

8. The polishing pad of claim 7, wherein the second hole has a cross-sectional area smaller than a cross-sectional area of the first hole.

9. The polishing pad of claim 7, further comprising a first adhesive layer arranged between the top pad layer and the sub-pad layer, the first adhesive layer including a third hole connected to the first hole and the second hole.

10. The polishing pad of claim 9, wherein the first adhesive layer has a thickness of 0.001 mm to 3 mm.

11. The polishing pad of claim 1, further comprising an additional adhesive layer arranged on a lower surface of the window block.

12. The polishing pad of claim 7, wherein the sub-pad layer comprises a thermally fused portion formed at a portion of the sub-pad layer adjacent to a lower surface of the window block.

13. The polishing pad of claim 1, wherein the top pad layer and the window block satisfy Formula 2:

$$1.1 \leq \frac{\text{Gap} + Thk_{RTPC}}{Thk_{grv}} \leq 1.9.$$

14. The polishing pad of claim 1, wherein the window block further includes a gap-controlling film formed on the upper surface of the window block.

15. A method of manufacturing a polishing pad, the method comprising:

providing a top pad layer with a groove pattern on an upper surface of the top pad layer;

forming a first hole in the top pad layer; and forming a window block in the first hole such that a first hole gap is formed between the upper surface of the top pad layer and an upper surface of the window block, wherein the top pad layer and the window block are formed to satisfy Formula 1, $$1.1 \leq \frac{\text{Gap} + Thk_{RTPC}}{Thk_{grv}} \leq 3.0,$$

wherein Gap in Formula 1 indicates a height difference between the upper surface of the top pad layer and an upper surface of the window block at the first hole gap, and the Gap in Formula 1 ranges from 0.001 mm to 2 mm, $\text{Thk}_{RTPC}$ indicates a thickness of the window block and $\text{Thk}_{grv}$ indicates a depth of the groove pattern.

16. The method of claim 15, further comprising:

forming a gap-controlling film for adjusting the height difference on one surface of the window block; and pressing an upper surface of the gap-controlling film.

17. The method of claim 15, further comprising:

forming a sub-pad layer with a second hole smaller than the first hole, on a lower surface of the top pad layer;

forming a first adhesive layer with a third hole between the lower surface of the top pad layer and the sub pad layer; and forming an additional adhesive layer on an upper surface of the first adhesive layer around the third hole.

18. The method of claim 17, further comprising forming a fused portion on a lower surface of the first adhesive layer exposed by the second hole.

19. The method of claim 15, wherein the top pad layer and the window block are formed to satisfy Formula 2, $$1.1 \leq \frac{\text{Gap} + Thk_{RTPC}}{Thk_{grv}} \leq 1.9.$$

* * * * *